US012790669B2

(12) United States Patent
Dues

(10) Patent No.: US 12,790,669 B2
(45) Date of Patent: Nov. 10, 2026

(54) PcBN SINTERED COMPACT

(71) Applicant: Diamond Innovations, Inc., Worthington, OH (US)

(72) Inventor: Lawrence Dues, Dublin, OH (US)

(73) Assignee: DIAMOND INNOVATIONS, INC., Worthington, OH (US)

( * ) Notice: Subject to any disclaimer, the term of this patent is extended or adjusted under 35 U.S.C. 154(b) by 421 days.

(21) Appl. No.: 18/624,400

(22) Filed: Apr. 2, 2024

(65) Prior Publication Data

US 2024/0247344 A1 Jul. 25, 2024

Related U.S. Application Data

(63) Continuation of application No. 17/254,151, filed as application No. PCT/US2018/039932 on Jun. 28, 2018, now Pat. No. 11,976,345.

(51) Int. Cl.

| | |
|---|---|
| ***B22F 7/06*** | (2006.01) |
| ***B22F 3/14*** | (2006.01) |
| ***C22C 26/00*** | (2006.01) |
| ***C22C 29/06*** | (2006.01) |

(52) U.S. Cl.
CPC ..... *C22C 26/00* (2013.01); *B22F 3/14* (2013.01); *B22F 7/06* (2013.01); *C22C 29/06* (2013.01); *B22F 2302/10* (2013.01); *B22F 2302/205* (2013.01); *C22C 2026/006* (2013.01)

(58) Field of Classification Search
CPC ..... B22F 7/06; B22F 2302/205
See application file for complete search history.

(56) References Cited

U.S. PATENT DOCUMENTS 5,639,285 A * 6/1997 Yao ..... C22C 26/00 428/404
2016/0052827 A1* 2/2016 Matsuda ..... C22C 26/00 264/626

* cited by examiner

*Primary Examiner* — Adam Krupicka
(74) *Attorney, Agent, or Firm* — Ari G. Zytcer

(57) ABSTRACT

The present application is a new improvement in the fine-grained cubic boron nitride sintered compact which may be employed to manufacture a cutting tool. The compact contains at least 80 vol % cBN with a metallic binder system and is sintered under HPHT conditions. The improvement incorporates alloys of aluminum in the metallic binder system. The invention has proved beneficial in the machining of cast iron.

5 Claims, 4 Drawing Sheets

PcBN SINTERED COMPACT

SUMMARY

A polycrystalline cubic boron nitride (PcBN) compact comprised of, in volume percent, from about 80% to of about 95% of cBN; and a metallic binder system. The PcBN compact is especially useful in machining cast iron and similarly chemical reactive parts.

BACKGROUND

Figure 1:
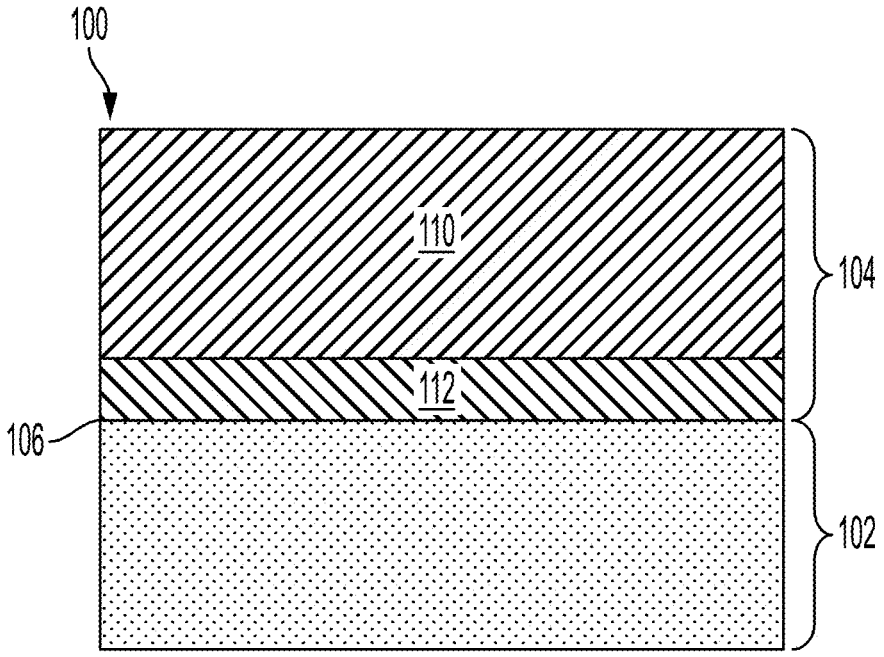
FIG. 1 is a general schematic of a cutting elements

Manufacture of cBN by the high pressure/high temperature (HP/HT) process is known in the art and explained in U.S. Pat. Nos. 2,947,617. A process for making sintered polycrystalline cBN compacts, which utilizes pyrolytic hexagonal boron nitride (HBN) in the absence of a catalyst is described in U.S. Pat. No. 4,1888,194. An improvement on such direct conversion process is described in U.S. Pat. No. 4,289,503, where boric oxide is removed from the surface of the HBN powder before the conversion process.

A compact as used in the cutter art comprises a mass of abrasive particles bonded together in a self-bonded relationship, by means of a bonding medium, or by means of combinations thereof. A composite compact is a compact bonded to a substrate material, such as cemented metal carbide. U.S. Pat. No. 3,918,219 describes the catalytic conversion of hexagonal boron nitride (HBN) to cBN in contact with a carbide mass to form a composite cBN compact. Compacts or composite compacts may be used in blanks for cutting tools, drill bits, dressing tools, and wear parts.

DETAILED DESCRIPTION OF THE INVENTION

The blended mixture is dried to remove the solvent, such as, isopropyl alcohol, acetone, at a temperature below the flash point of the solvent. The powder subsequently is granulated to aid in further processing. The composition of the blended material can be modified so that the relative contents of the ingredients adhere to the ranges desired.

The powder may be subjected to sintering using conventional HPHT techniques and apparatus well known in the art, such as described above. The powder is loaded in refractory metal cups such as Ta or Nb. The size of the cups limits the size of the final sintered compact. A backing substrate material in powder or compact can be loaded into the cup for in situ bonding to the sintered eBN compact, as is known in this art. Suitable substrates include, for example, cemented carbides, for example Tungsten Carbide (WC) with Cobalt (Co) or other Group VIII binders. Crimping the cup material around the edges of the substrate seals the cup. In this invention, the composition of the cemented carbide substrate was selected to improve the performance of the cutting tool.

This sealed cup assembly then is loaded into a high pressure cell which consists of pressure transmission and pressure sealing materials and then subjected to high pressure, such as 4.5-6.5 GPa and high temperature above 1200 °C for 10-40 minutes to sinter the powder mixture and bond it to the substrate. The sintered blank is removed from the cell and machined to remove the cup material and to bring it to the desired dimensions. The finished blank is cut, for example by electro-discharge machining (EDM) or by a laser, into shapes and sizes suitable for the manufacture of cutting tools used for machining powder metal iron and other similar materials. The size and shape of the described sintered blanks can be varied by changing the dimensions of the components and are primarily limited in dimension by the high pressure/high temperature (HPHT) equipment used to promote the sintering process.

The sintered cBN compact product comprises between about 80 vol % and 95 vol % cBN grains with mean size of less than S microns (μm) with the remainder of the material consisting of the binder phase, which is uniformly dispersed among the cBN grains. During the HPHT process, an aluminum-containing compound added into the powder during the milling and blending step begins to react with the cubic boron nitride and begins the sintering. Cobalt and chromium from the cemented carbide substrate also liquefies during HPHT and infiltrates the powder bed, eliminating any porosity and further aiding sintering.

FIG. 1 presents a general schematic of a cutting elements which comprise a substrate and a layer of PcBN material. The layer of PcBN material includes a working surface at a first surface. At a second, opposing surface, the layer of PcBN material is sintered to the substrate. The layer of PcBN material has a composition including cBN; an aluminum containing compound; group VIII binder metal or alloy thereof; and a metal from Group V, Group VI, or Group VII. In one example, the layer of PcBN material has a composition including cobalt and chromium.

The cutting element 100 includes a substrate 102 and a layer of PcBN material 104 which meet at an interface 106. A region 110 in the layer of superhard material 104 remote from the interface 106 has a composition that is substantially bulk superhard material. In the vicinity of the interface 106, there is a diffusion zone 112. The diffusion zone forms during manufacturing, such as by processing at high temperature and high pressure (HPHT). During manufacturing, the Group VIII binder metal in the substrate 102 infiltrates into the layer of superhard material 104 under pressure and temperature resulting in the Group VIII binder metal from the substrate 102 moving into the layer of superhard material 104. This results in the diffusion zone 112 being rich in Group VIII binder metal. Along with movement of the Group VIII binder metal, metal from Group V, Group VI, or Group VII also present in the substrate migrates from the substrate into the layer of PcBN material. In the substrate 102 and in the diffusion zone 112, the Group V, Group VI, or Group VII metal exists as an alloy with Group VIII metal. In the bulk of the PcBN material 110, the Group V, Group VI, or Group VII metal exists as an alloy with aluminum.

Figure 2:
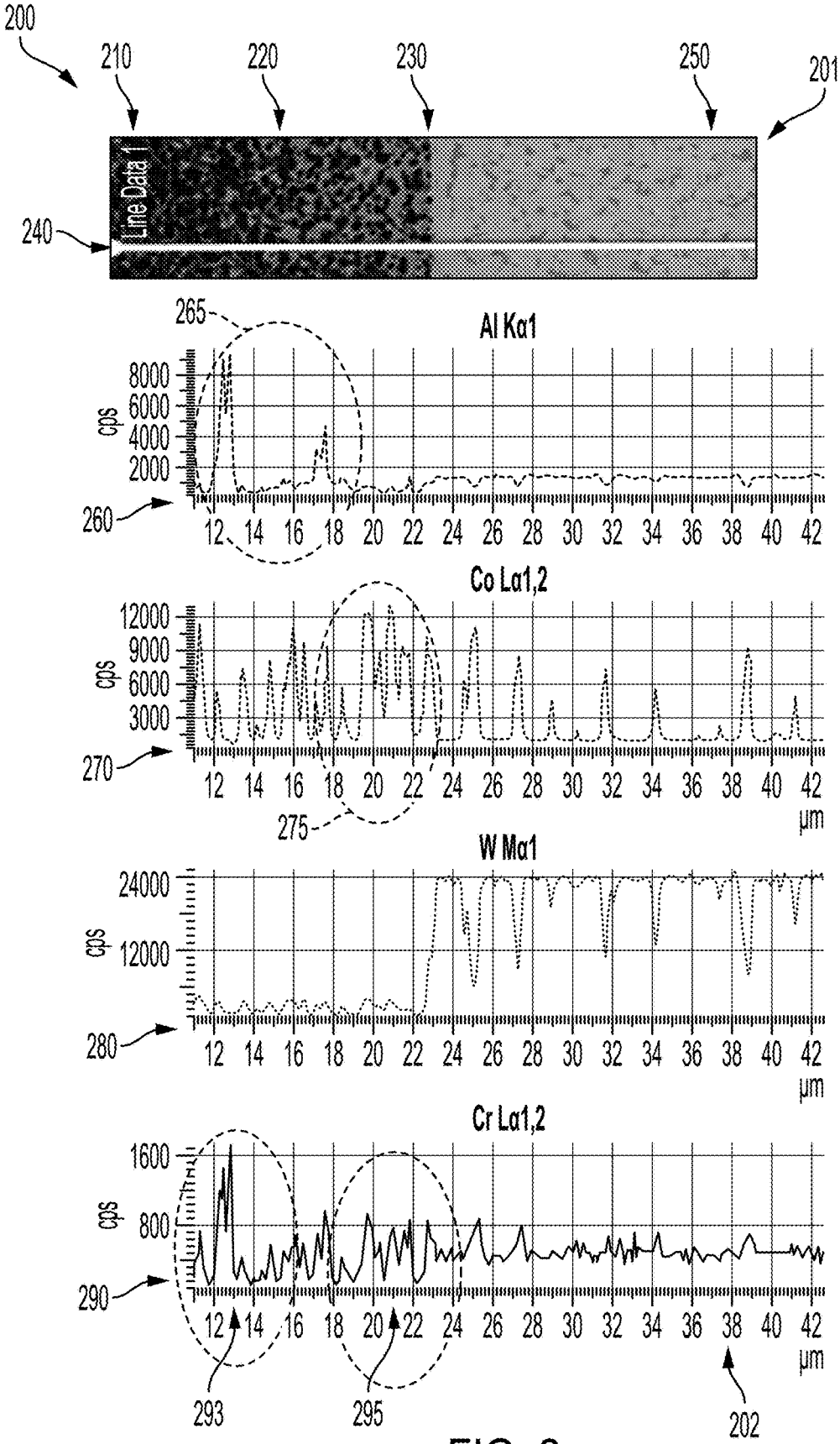
FIG. 2 is a comparative combination of a picture of a cross section of the material cubic boron nitride (cBN) and WC contrasted with line scans.

FIG. 2 presents a comparative combination 200 of a picture of a cross section 201 of the material cubic boron nitride (cBN) and WC contrasted with line scans 202. A scanning electron microscope or SEM micrograph 201 of a cross-section of an exemplary embodiment of a cutting element showing the substrate 250, the layer of superhard material 210, the interface of the substrate and the layer of superhard material 230, the reaction zone 220 and the depletion zone. The reaction zone 220 extends from the interface 230 of the layer with the substrate 250 into the layer of superhard material 210 toward the working surface of the cutting element.

Proceeding from the left side of the picture 210 to the right side of the picture 250, the concentration of various materials is shown. The most pronounced change occurs at the interface 230 between the cBN layer 210 and the WC layer 250. Located beneath the picture 201 is a series of line scans 202 which present a graphical representation of the amount of aluminum 260, cobalt 270, tungsten 280 and chromium 290 contained within the cBN layer zone, the WC layer zone and the interface region also known as the diffusion zone there between. The intensity of the line scans 202 measured in counts per second is a measure of how much of the indicated material, in this case aluminum 260, cobalt 270, tungsten 280 and chromium 290, are present on the material tested, in this case the cBN and WC layer. The line scans 202 proceed from left 210 to right 250 and directly corresponds to the picture 201 such that at any given location in the picture the corresponding line scan 202 directly below the picture 201 indicates the composition of the material.

FIG. 2 highlights the cobalt (Co) 270 contained within the sample material. The line scan varies in intensity across the length of the line scan and of the sample, with the greatest intensity and fluctuation at or near the interface 275, where the cBN and the WC intersect 230. The horizontal white line 240 shows the location used to collect the EDS line scan shown in the image below. The working surface would be off the left side of the image 210. FIG. 2 also highlights the chromium (Cr) 290 contained within the sample material. The line scan varies in intensity across the length of the line scan and of the sample, with the greatest intensity and fluctuation at or near the interface 295. Both the cobalt scan line and the chromium lines fluctuate in synch or in unison with each other in the WC substrate on the right side, indicating that the cobalt and the chromium are alloyed together in the WC substrate. A similar alloying is also occurring near the WC interface in the diffusion layer.

FIG. 2 also highlights the aluminum 260 and chromium 280 contained within the sample. The aluminum line scan 260 peaks at a highest point at the left most part of the line scan 265 corresponding to the left most portion of the sample that is furthest away from the cBN and WC interface 230. The chromium 290 also peaks at a highest point at the left most part of the line scan 293 corresponding to the left most portion of the sample that is furthest away from the cBN and WC interface 230. This serves to indicate that the chromium and aluminum are alloyed together in the bulk of the cBN layer 210.

The aluminum level peaks closest to the cBN layer furthest from the interface. The first embodiment, a cobalt and chromium infiltration is performed in a high concentration of cBN materials. Such includes a polycrystalline sintered body comprising of a substrate, a layer of cBN sintered to the substrate, the layer including a working surface at a first surface, and a diffusion zone extending into the cBN layer from the interface of the substrate toward the working surface. Within such, the layer of cBN consists of 80-95 vol % cBN; an aluminum source comprising titanium aluminide, nickel aluminide, and/or aluminum; and chromium or alloy thereof that mixes with an Group VIII binder metal in the substrate, wherein the chromium is alloyed with the Group VIII binder metal in the diffusion layer, and the chromium is alloyed with aluminum at the working surface of the PcBN layer away from the interface. Alternatives to chromium are other Group V, Group VI, or Group VII metals.

Figure 3:
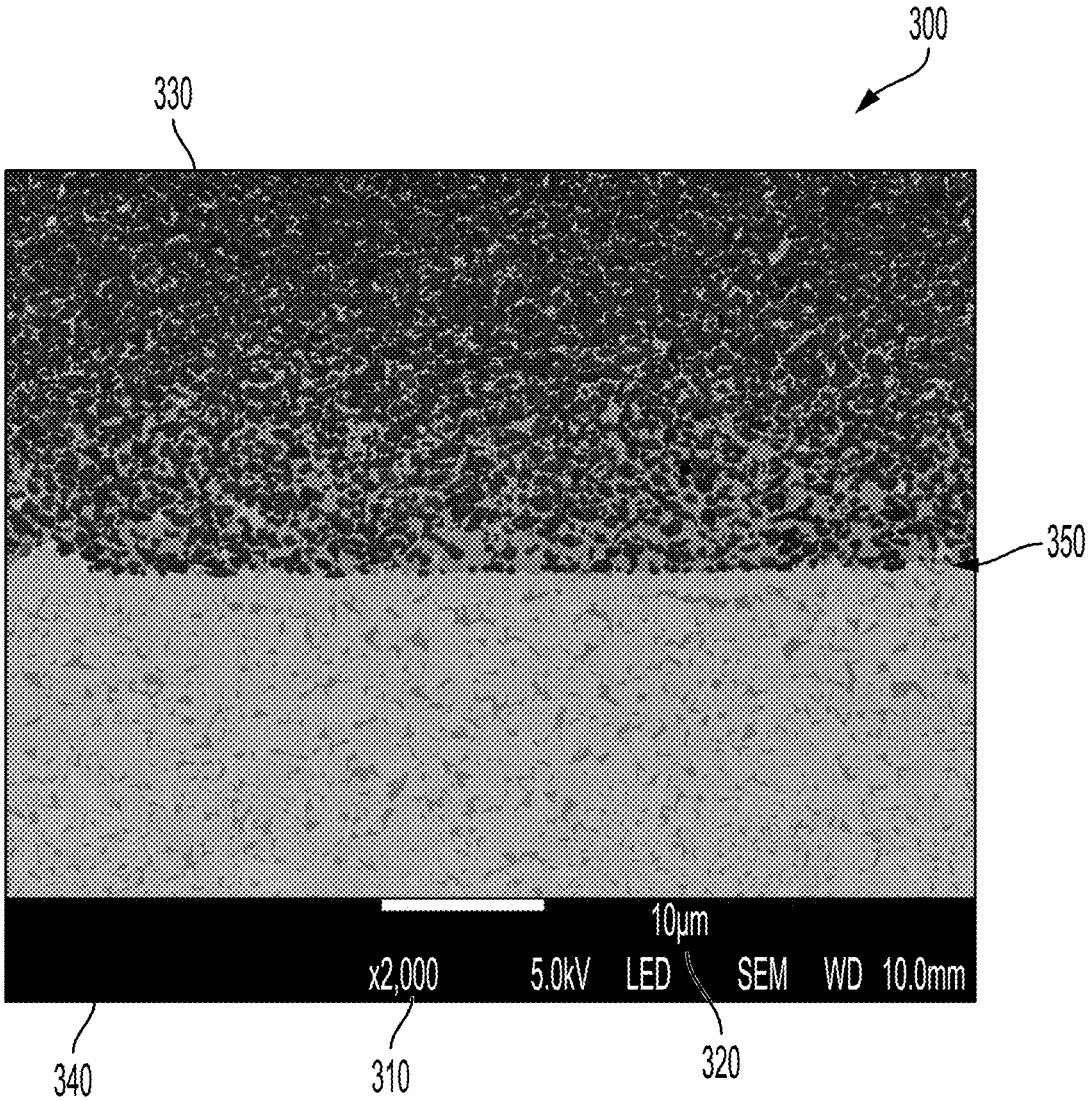
FIG. 3 is an image of the microstructures in the reaction zone.

FIG. 3 presents an image 300 of the microstructures in the reaction zone at a 2000×SEM size 310 with a 10 micron scale bar 320. The image demonstrates that cBN concentration is much lower at the WC/cBN interface 350, which indicates that the cobalt and chromium are infiltrating the cBN layer from the cemented carbide substrate. This SEM image shows the pCBN layer on the top 330 and the WC substrate on the bottom 340.

Figure 4:
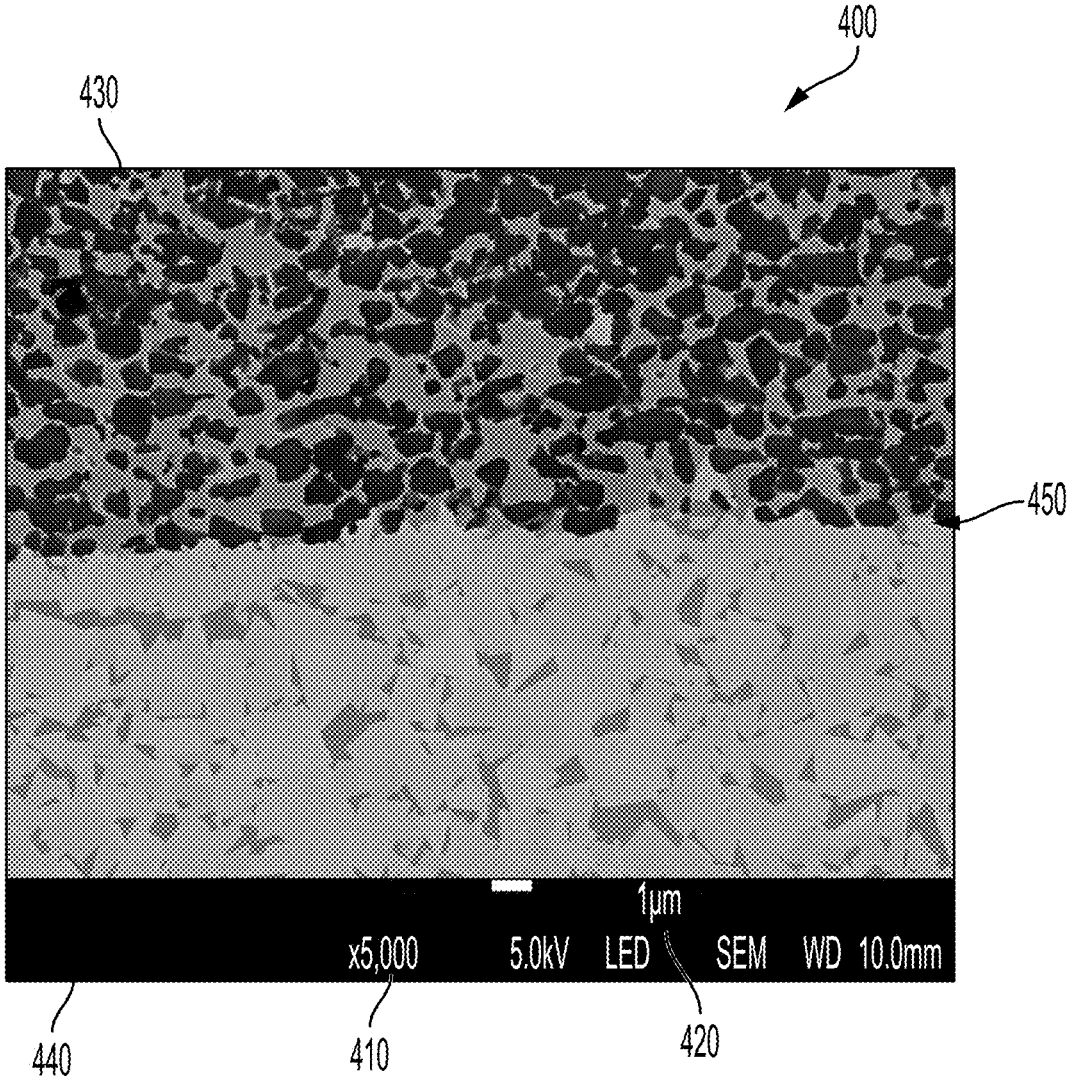
FIG. 4 is an image of the microstructures in the reaction zone.

FIG. 4 presents an image 400 of the microstructures in the reaction zone at a 5000×SEM image 410 with 1 micron scale bar 420. The lower portion shows the cemented WC substrate, with the brightest phase 440 being WC and the slightly dark phase 430 being Co and chromium (placement of 430 is incorrect in figure, maybe include 430 in both WC substrate and cBN layer). The upper portion shows the polycrystalline cBN material. The darkest regions are cBN grains. The lighter gray is the Cobalt and Chromium infiltrating from the substrate at the interface 450.

In one embodiment, a polycrystalline sintered body consisting of 80-95 vol % cBN; an aluminum source comprising titanium aluminide, nickel aluminide, and/or aluminum; and at least one Group VIII metal and at least one Group V, VI, or Group VII metal that infiltrate the cBN layer as a liquid phase during HPHT. The infiltrating metals may be provided as metal disk(s) or as component(s) in the cemented carbide substrate, or as a combination of both.

In a further embodiment, a refinement combining elements of the afore mentioned embodiments comprises a polycrystalline sintered body consisting of 80-95 vol % cBN; an aluminum source comprising titanium aluminide, nickel aluminide, and/or aluminum; wherein the cBN layer is sintered to a cemented carbide substrate and chromium is present near the interface of the cemented carbide as an alloy of chromium and cobalt. Here, chromium is present at the working surface as an alloy of chromium and aluminum.

Performance testing demonstrates embodiment, enablement, and a new and novel benefit of the invention. Materials were evaluated in cast iron milling using the following conditions:

Axial and radial rake angle=5 degrees

Lead angle=15 degrees $Vc$=1000 m/min $f$=0.1 mm $Ap$=0.5 mm $Ae$=52.37 mm

Conventional material (Cobalt only infiltration during HPHT) failed due to chipping in average of 8 passes. The exemplary material (Identical powder composition used in conventional material. Cobalt and chromium infiltration during HPHT with aluminum and chromium alloying at working surface) failed due to chipping in an average of 10 passes. This increase in tool life indicates an increase in fracture toughness of the inventive material. While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

The invention claimed is:

1. A sintered body, comprising:

a cBN layer comprising 80-95 vol % cBN;

an aluminum source comprising at least one of titanium aluminide (TiAl), nickel aluminide ($Ni_3Al$), or a combination thereof;

an interface;

a substrate comprising cemented tungsten carbide (WC); and at least one Group VIII metal, and at least one Group V, Group VI, or Group VII metal, wherein the Group V. Group VI, or Group VII metal is present as an alloy with the aluminum source in the cBN layer away from the interface, and wherein the cBN layer is sintered to the cemented tungsten carbide (WC) substrate.

2. The sintered body of claim 1, wherein the Group VIII metal is one of iron (Fe), Co, or nickel (Ni), and the Group V, Group VI, or Group VII metal is one of vanadium (V), Cr, or manganese (Mn).

3. The sintered body of claim 2, wherein the Group VIII metal is Co, and the Group V, Group VI, or Group VII metal is Cr.

4. The sintered body of claim 3, wherein the Co and the Cr infiltrate the cBN layer.

5. The sintered body of claim 4, wherein the Co and the Cr infiltrating the cBN layer are provided as at least one metal disk or as components in the cemented tungsten carbide (WC) substrate.

* * * * *